US006491369B1

(12) United States Patent
Satoh et al.

(10) Patent No.: US 6,491,369 B1
(45) Date of Patent: Dec. 10, 2002

(54) HEAD CLEANING UNIT FOR INK-JET PRINTER CAPABLE OF SUFFICIENTLY SUCKING UP WASTE INK

(75) Inventors: Makoto Satoh, Niigata (JP); Hisanaga Shirasu, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/669,850

(22) Filed: Sep. 27, 2000

(30) Foreign Application Priority Data

Sep. 27, 1999 (JP) ..... 11-272649

(51) Int. Cl.[7] ..... B41J 2/165
(52) U.S. Cl. ..... 347/30; 347/29
(58) Field of Search ..... 347/30, 29

(56) References Cited

U.S. PATENT DOCUMENTS 6,220,689 B1 * 4/2001 Sturgeon ..... 347/29

FOREIGN PATENT DOCUMENTS

| | | | |
|---|---|---|---|
| EP | 0 844 092 A2 | 5/1998 | |
| EP | 0 901 905 A2 | 3/1999 | |
| JP | 4-259564 | 9/1992 | |
| JP | 04-259564 | 9/1992 | |
| JP | 7-40538 | 2/1995 | |
| JP | 09-300641 | 11/1997 | |
| JP | 9-300641 | 11/1997 | |
| JP | 10-211714 | 8/1998 | |
| JP | 10-235884 A * | 9/1998 | ..... B41J/2/165 |
| JP | 10-264402 | 10/1998 | |
| JP | 11-157088 | 6/1999 | |
| WO | WO 91/14576 | 10/1991 | |

OTHER PUBLICATIONS

European Search Report dated Dec. 19, 2000.
Japanese Office Action dated Dec. 11, 2001 with partial English Translation.

* cited by examiner

*Primary Examiner*—John S. Hilten
*Assistant Examiner*—Shih-Wen Hsieh
(74) *Attorney, Agent, or Firm*—McGinn & Gibb, PLLC

(57) ABSTRACT

A head cleaning unit for cleaning a printing head by sucking waste ink from the printing head, includes an ink collector attached to a cap so as to contact with the cap. The cap includes a plurality of first ink-suck holes formed on a bottom surface of a liquid room so as to communicate the liquid room with a space between the cap and the ink collector. The ink collector includes a second ink-such hole form on a bottom surface of the ink collector, adjacent to the space so as to communicate the space with a vacuum. At least one of the cap and the ink collector includes an air-intake hole for providing air to the cap or the ink collector. At least one of the first ink-such holes is disposed along a periphery of the space, where the printing head and the cap are in contact.

12 Claims, 5 Drawing Sheets

HEAD CLEANING UNIT FOR INK-JET PRINTER CAPABLE OF SUFFICIENTLY SUCKING UP WASTE INK

BACKGROUND OF THE INVENTION

This invention relates to a head cleaning unit which is applied to an ink-jet printer performing printing with reciprocating a carriage provided with a printing head back and forth, in particular, to the cleaning unit for cleaning the printing head by sucking up waste ink from an inside and an outside of the printing head.

Generally, the ink-jet printer prevents the printing head from drying by covering an end surface of a nozzle (a nozzle surface) of the printing head by a cap when the ink-jet printer does not perform printing. Furthermore, the ink-jet printer removes the waste ink containing air bubbles and dust by a head cleaning unit. The head cleaning unit has a pump. The suck pump vacuums out a space between the nozzle surface and the cap so as to suck up the waste ink from the printing head to the space. The waste ink sucked up to the space is discharged through an ink-suck tube and the suck pump.

For example, such kind of head cleaning units are disclosed in Japanese Patent Unexamined Publications (JP-A) Nos. 259564/1992 and 300641/1997.

In a conventional head cleaning unit for the ink-jet printer, a nozzle surface of a printing head is covered with a cap. On one side of a bottom portion of a liquid room formed in the cap, an ink-suck hole for sucking up the waste ink from a nozzle through the liquid room is formed. On the other side of the bottom portion of the liquid room, an air-intake hole for sucking the air into the liquid room is formed. Furthermore, an ink-suck tube communicated with a suck pump is coupled with the ink-suck hole.

When the suck pump is driven, the liquid room is vacuumed into negative pressure so that the waste ink is sucked up from the nozzle of the printing head. On the other hand, the air is sucked up into the liquid room through the air-intake hole. Thus, the waste ink is sucked up (led) into the ink-suck tube through the liquid room together with the air from the air-intake hole.

However, if the conventional head cleaning unit mentioned above sucks up the waste ink with the suck pump driven, the unit cannot sufficiently suck up the waste ink so that the waste ink tends to be left at a slight space between the nozzle surface and the cap and corners of the bottom portion of the liquid room. This is because the only one ink-suck hole and the only one air-intake hole are formed on one and the other sides of the bottom portion of the liquid room, respectively. When the waste ink is left in the cap, the waste ink sticks on the printing head and soils the printing head. The waste ink stuck to the printing head drips onto a printing medium and soils the printing medium when the printing is performed.

Therefore, the waste ink tends to be left near the corners and border areas between a bottom surface and enclosure-walls limiting the liquid room of the cap. Furthermore, it is difficult to sufficiently remove the waste ink from the areas mentioned above by sucking.

Particularly, it is very difficult that such type of head cleaning unit provided with the only one ink-suck hole formed near the central area of the bottom surface of the cap sucks up the waste ink left in the areas mentioned above.

SUMMARY OF THE INVENTION

It is an object of this invention to deal with disadvantages mentioned above and to therefore provide a head cleaning unit for an ink-jet printer capable of sufficiently sucking up waste ink from a nozzle of a printing head and from a cap so as to prevent a nozzle surface from being soiled.

The other object, features, and advantages of this invention will become clear as the description proceeds.

This invention is directed to a head cleaning unit, applied to an ink-jet printer performing printing with driving a printing head, for cleaning the printing head by sucking up waste ink from the printing head, the head cleaning unit comprising a cap capable of covering with the printing head so as to contact with the printing head and vacuum means for generating negative pressure in a liquid room formed in the cap, the head cleaning unit cleaning the printing head by sucking up the waste ink from the printing head. The head cleaning unit further comprises an ink collector attached to the cap so as to contact with the cap. The cap is provided with a plurality of first ink-suck holes formed on a bottom surface of the liquid room so as to communicate the liquid room with a space limited between the cap and the ink collector. The ink collector is provided with a second ink-suck hole formed on a bottom surface adjacent to the space so as to communicate the space with the vacuum means. At least one of the cap and the ink collector is provided with an air-intake hole for providing air to the cap or the ink collector by the vacuum means. At least one of the first ink-suck holes is arranged along a contact area where the printing head and the cap are brought into contact with each other.

DESCRIPTION OF THE PREFERRED EMBODIMENTS

Figure 1:
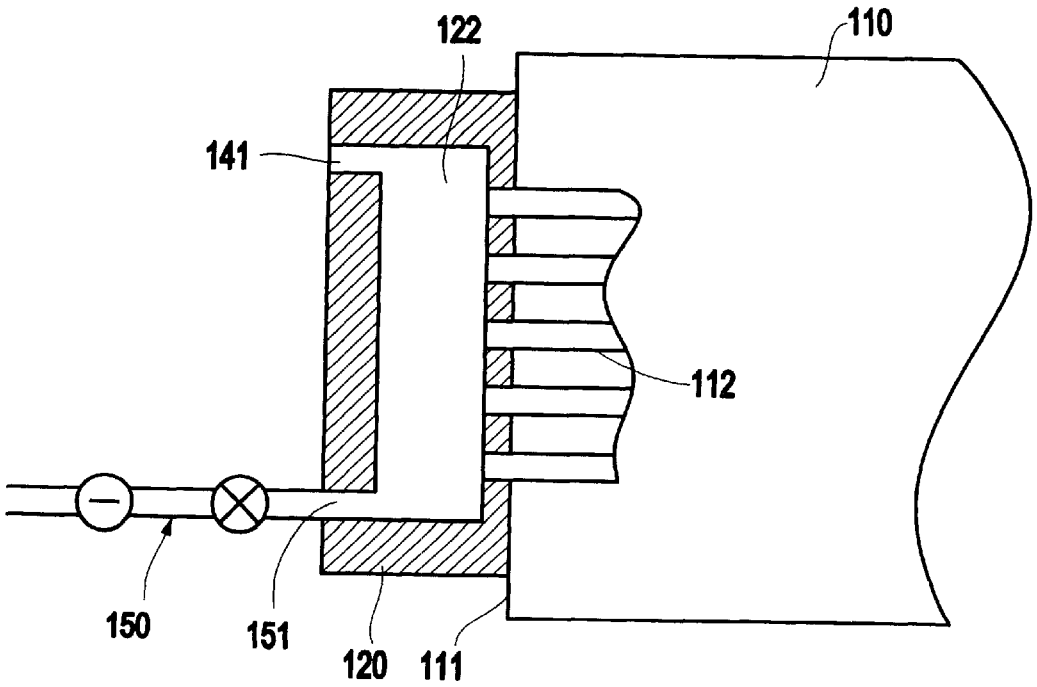
FIG.1 PRIOR ART
FIG. 1 is a schematic cross sectional view of a conventional head cleaning unit.

In order to facilitate an understanding of the present invention, description will be at first made with reference to the drawing about the head cleaning unit as the conventional technique related to this invention described in the background of this specification.

FIG. 1 shows a conventional head cleaning unit for the ink-jet printer. Referring to FIG. 1, a nozzle surface 111 of a printing head 110 is covered with a cap 120. On one side of a bottom portion of a liquid room 122 formed in the cap 120, an ink-such hole 151 for sucking up the waste ink from a nozzle 112 through the liquid room 122 is formed. On the other side of the bottom portion of the liquid room 122, an air-intake hole 141 for sucking the air into the liquid room 122 is formed. Furthermore, an ink-suck tube 150 communicated with a suck pump (not shown) is coupled with the ink-suck hole 151.

When the suck pump is driven, the liquid room 122 is vacuumed into negative pressure so that the waste ink is sucked up from the nozzle 112 of the print head 110. On the other hand, the air is sucked up into the liquid room 122 through the air-intake hole 141. Thus, the waste ink is sucked up (led) into the ink-suck tube 150 through the liquid room 122 together with the air from the air-intake hole 141.

The head cleaning unit has problems described in the background.

Namely, if the conventional head cleaning unit mentioned above sucks up the waste ink with the suck pump driven, the unit cannot sufficiently suck up the waste ink so that the waste ink tends to be left at a slight space between the nozzle surface 111 and the cap 120 and corners of the bottom portion of the liquid room 122. This is because the only one ink-suck hole 151 and the only one air-intake hole 141 are formed on one and the other sides of the bottom portion of the liquid room 122, respectively. When the waste ink is left in the cap 120, the waste ink sticks on the printing head 110 and soils the printing head 110. The waste ink suck on the printing head 110 and drips onto a printing medium and soils the printing medium when the printing is performed.

Figure 2:
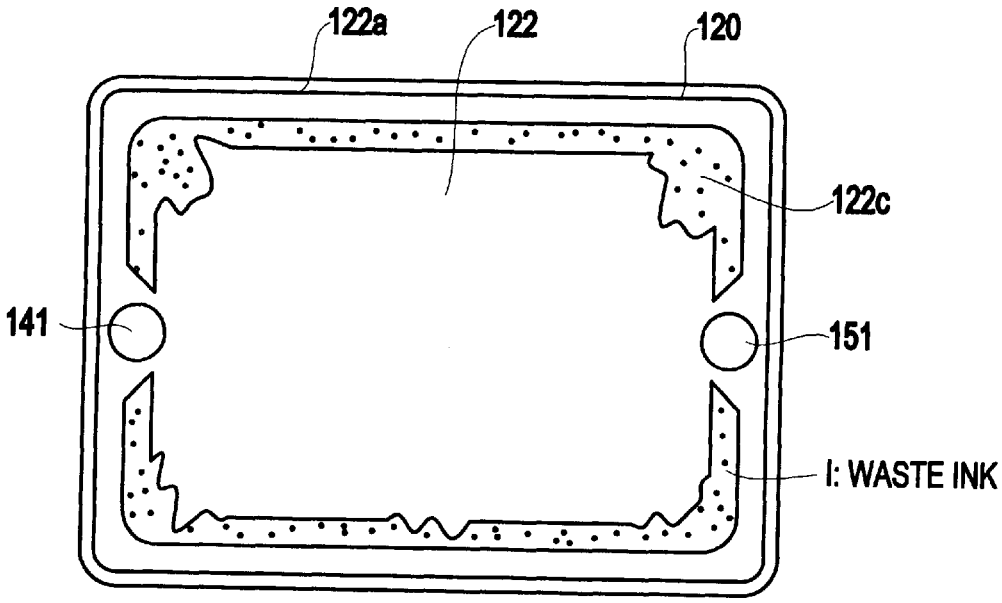
FIG.2 PRIOR ART
FIG. 2 is a plan view for illustrating distribution of the waste ink left but not suck up in the cap of the head cleaning unit shown in FIG. 1.

FIG. 2 shows the bottom portion of the cap 120 in order to illustrate distribution of the waste ink left but not sucked up in the cap 120. As shown in FIG. 2, the waste ink tends to be left near the corners 122*c* and border areas between a bottom surface and an enclosure-wall 122*a* of the cap 120 which limit the liquid room 122. Furthermore, it is difficult to sufficiently remove the waste ink from the areas mentioned above by suck.

Particularly, it is very difficult that such type of head cleaning unit (not show) provided with the only one ink-suck hole formed near the central area of the bottom surface of the cap sucks up the waste ink left in the areas mentioned above.

Now, a preferred embodiment of the present invention will be described with reference to Drawings.

Figure 3:
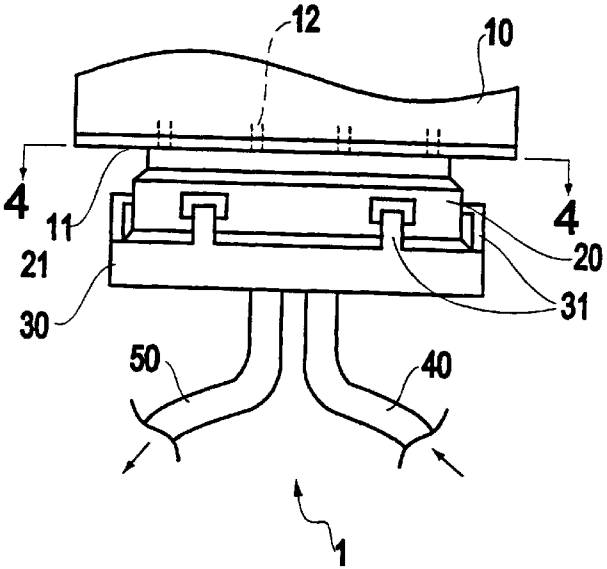
FIG. 3 is a side view of a head cleaning unit according to an embodiment of this invention.

Referring to FIG. 3, a head cleaning unit 1 according to an embodiment of this invention is generally structured by a cap 20 stuck on a nozzle surface 11 of a printing head 10 and an ink collector 30 removably attached to the cap 20. The head cleaning unit 1 is movable to the printing head so as to face to the printing head 10 by well known driving means not shown.

To the ink collector 30, an ink-suck tube 50 communicated with a suck pump (not show) serving as vacuum means is attached in order to recover a waste ink sucked up by the suck pump and an air-intake tube 40 is attached in order to provide air into the ink collector 30 by negative pressure generated by the suck pump.

The cap 20 is provided with engaging portions (primary engaging portions) 21 formed on side surfaces thereof. The engaging portions 21 have dent shape. On the other hand, the ink collector 30 is provided with engaging portions (secondary engaging portions) 31 upwardly protruded from side edges thereof so as to correspond to the engaging portions 21 of the cap 20.

Referring to FIGS. 4 and 5A to 5C accompanied with FIG. 3, the cap 20 is provided with a liquid room 22 therein for temporarily stocking with the waste ink sucked up from nozzles 12 of the printing head 10 (FIG. 3). The liquid room 22 is limited by four circumference walls 22*a*. Upper ends of the circumference walls 22*a* contacts with the nozzle surface 11. Namely, the nozzle surface 11 and the upper ends of the circumference walls 22*a* contact with each other so as to form a contact area. In this embodiment, in order to reduce the contact area in area as small as possible so that the waste ink left in the cap 20 is reduced in amount as little as possible, the circumference walls 22*a* are gradually reduced in width in cross section as a location thereof rises upwardly in height.

The cap 20 is further provided with a plurality of first ink-suck holes 23 and 24. The first ink-suck holes 23 are formed on a circumference region of a bottom surface 22*b* in the liquid room 22 along the circumference walls 22*a*. On the other hand, the first ink-suck holes 24 are formed on the central region of the bottom surface 22*b*.

Figure 4:
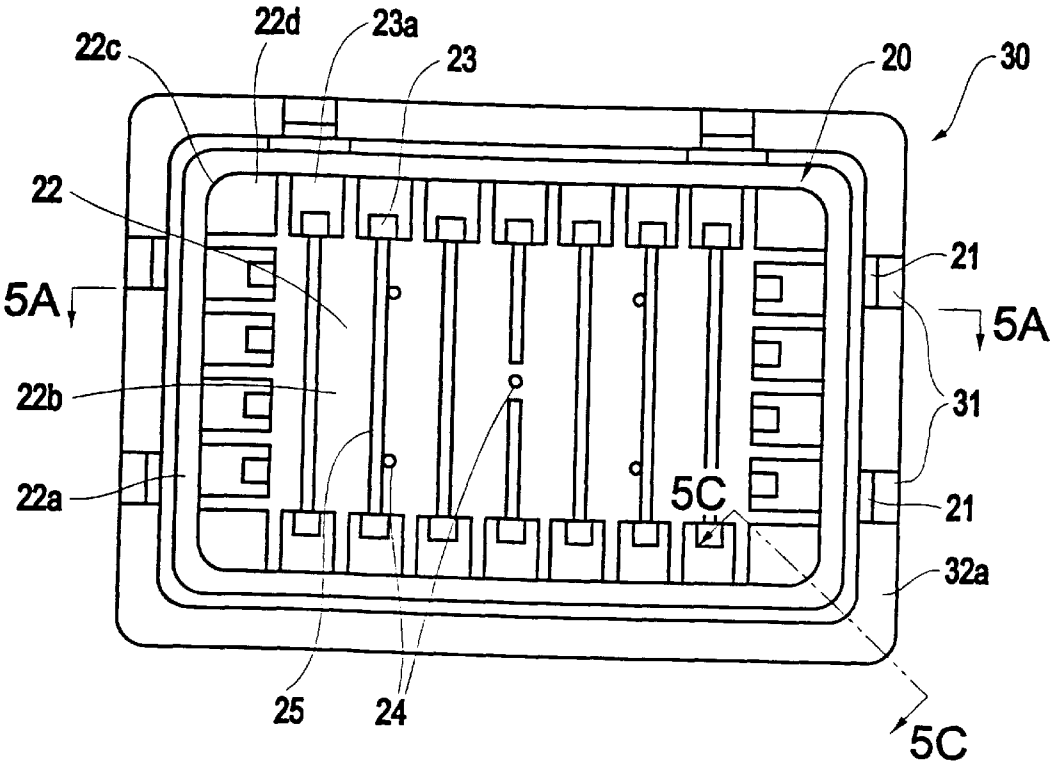
FIG. 4 is an arrow view of the head cleaning unit shown in FIG. 3 as seen from a direction of an arrow I—I.

In this embodiment, seven first ink-suck holes 23 are formed in equal pitch along longer one of the circumference walls 22*a* (extended in horizontal direction in FIG. 4). Four first ink-suck holes 23 are formed in equal pitch along shorter one of the circumference walls 22*a* (extended in vertical direction in FIG. 4). The sum number of the first in-suck holes 23 is twenty-two. On the other hand, one first ink-suck hole 24 is formed at the center of the bottom surface 22*b*. Four first ink-suck holes 24 are formed on the bottom surface 22*b* so as to be symmetric with respect to the first ink-suck hole 24 formed at the center. Thus, the total number of the first ink-suck holes 23 and 24 is twenty-seven.

It is not to say an arrangement and the number of the first ink-suck holes 23 and 24 are never limited in this embodiment. For example, all of the first ink-suck holes 23 and 24 may be formed along the circumference walls 22*a*. After all, it is preferable that the arrangement and the number of the first ink-suck holes 23 and 24 are designed with taking the flow of the air in the liquid room 22 into consideration.

The cap 20 is further provided with a plurality of grooves 25. The grooves 25 are formed in parallel so as to be extended from one of the longer circumference walls 22*a* to the other of the longer circumference walls 22*a*. The grooves 25 traverse the central region of the bottom surface 22*b* and are communicated with the first ink-suck holes 23 so as to efficiently guide the air existing in the liquid room 22 to the first ink-suck holes 23. In this embodiment, the number of the grooves 25 is eight. However, an arrangement and the number of the grooves 25 are never limited in this embodiment. It is preferable that the arrangement and the number of the grooves 25 are designed with taking the flow of the air in the liquid room 22 into consideration. For example, the grooves 25 may be also radially extended from the central region of the bottom surface 22*b* to arbitrary first ink-suck holes 23 or that the grooves 25 are extended so as to communicate the first ink-suck holes 23 with one another.

Figure 5A:
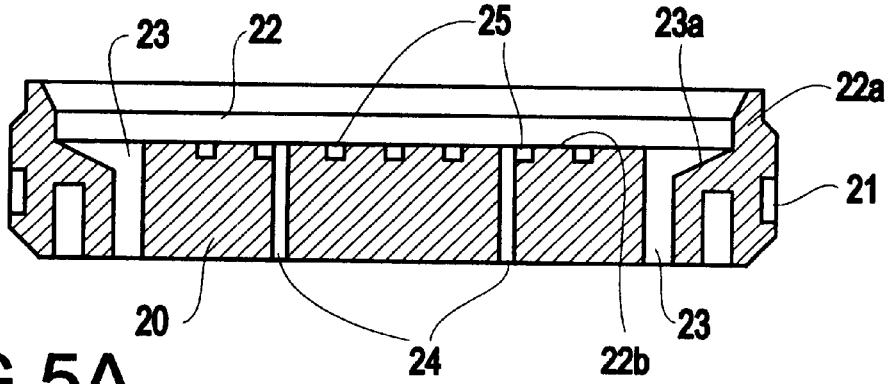
FIG. 5A is a cross sectional view of a cap of the head cleaning unit shown in FIG. 4 as sectioned by an arrow II—II.
Figure 5B:
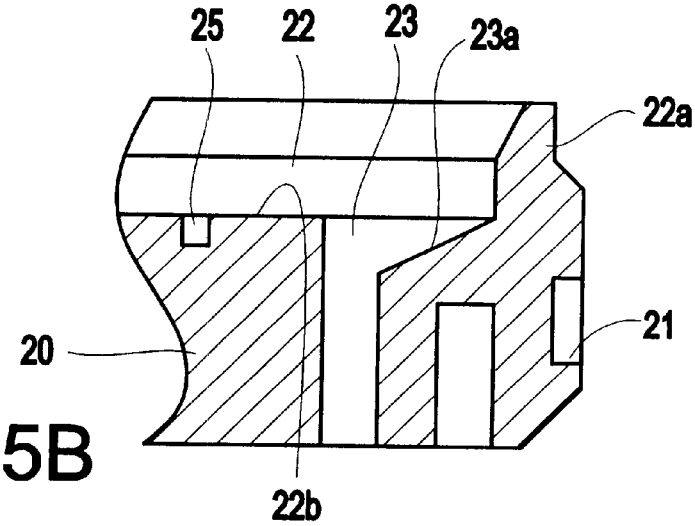
FIG. 5B is an enlarged partial view of the cap shown in FIG. 5A.
Figure 5C:
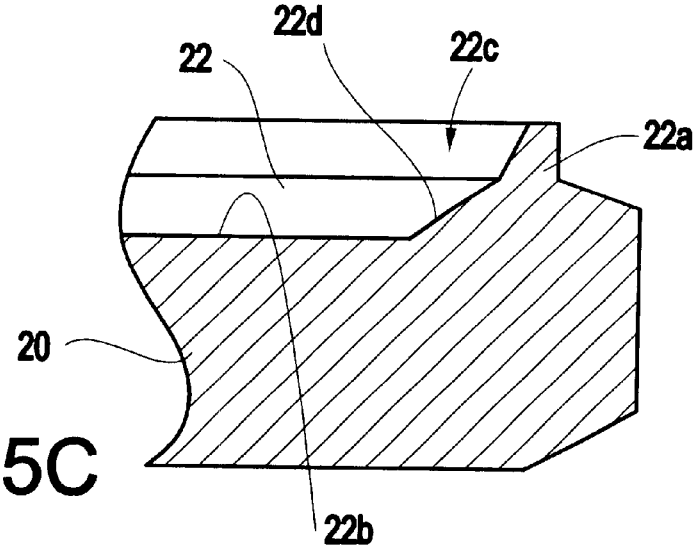
FIG. 5C is a cross sectional view of the cap of the head cleaning unit shown in FIG. 4 as sectioned by an arrow III—III.

As shown in FIG. 5B, upper portions of the first ink-suck holes 23 are gradually widened in cross section as a location thereof closes to the bottom surface 22*b* in depth. Namely, a slope 23*a* is formed at the upper portion. The slope 23*a* is extended from the center of a diameter of the first ink-suck hole 23 to a lower end of the circumference wall 22*a* so that boundary between the bottom surface 22*b* and the circumference wall 22*a* is shaped in an obtuse angle. Consequently, it is difficult that the waste ink is left at a corner formed between the bottom surface 22*b* and the circumference wall 22*a*. Furthermore, if the waste ink is left at the corner, the waste ink is smoothly sucked up.

Furthermore, corners 22*c* formed between the circumference walls adjacent to each other has round shape as shown in FIG. 4. In addition, the cap 20 is provided with slope 22*d* formed between the bottom surface 22*b* and the circumference wall 22*a*. Consequently, it is difficult that the waste ink is left in the cap 20. Furthermore, if the waste ink is left in the cap 20, the waste ink is smoothly sucked up. Although the slope 22*d* is formed between the bottom surface 22*b* and the circumference wall 22*a* in this embodiment, an arc surface may be formed instead of the slope 22*d*. The slope 22*d* or the arc surface brings in no susceptible shape to left the waste ink.

Hereinafter, the ink collector 30 will be described.

Figure 6:
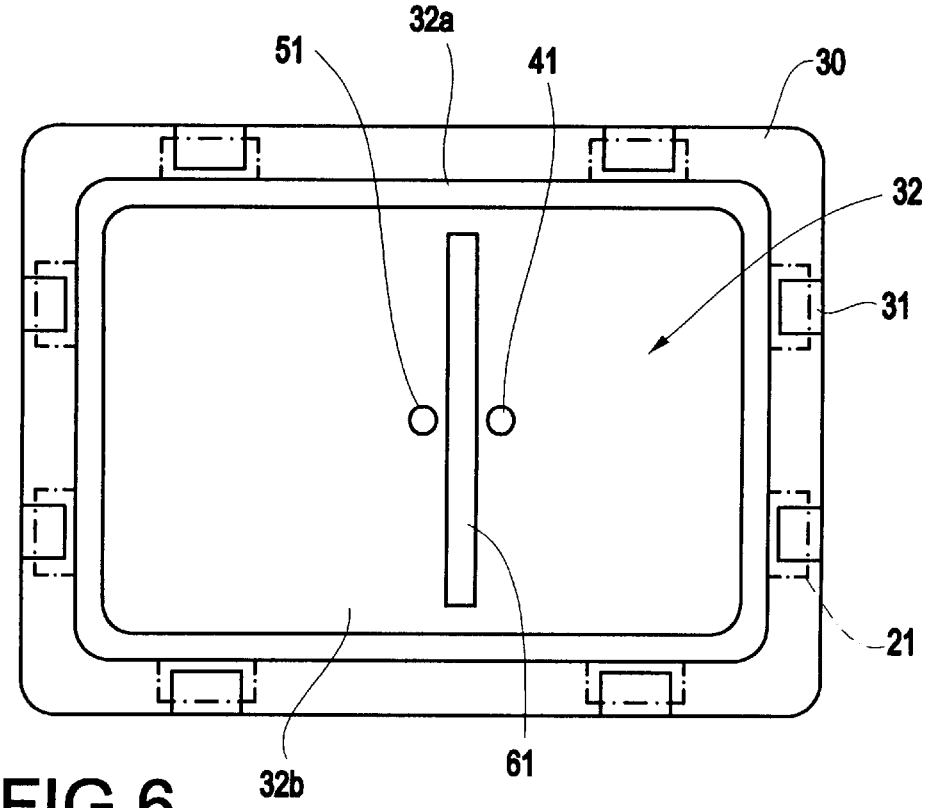
FIG. 6 is a plan view of an ink collector of the head cleaning unit shown in FIG. 3.

Referring to FIG. 6, the ink collector 30 is provided with a collecting room 32 formed therein for temporarily stocking with the waste ink sucked up from the cap 20. The collecting room 32 is limited by four circumference walls 32*a*. When the ink collector 30 is attached to the cap 20, upper ends of the circumference walls 32*a* contact with the cap 20 so that the collecting room 32*a* is closed tightly.

Near the central region of a bottom surface 32*b* of the collecting room 32, a second ink-suck hole 51 and an air-intake hole 41 are formed. The second ink-suck hole 51 is communicated with the ink-suck tube 50. On the other hand, the air-intake hole 41 is communicated with the air-intake tube 40. When the second ink-suck hole 51 and the air-intake hole 41 are adjacent to each other as shown in FIG. 6, air directly flows from the air-intake hole 41 to the second ink-suck hole 51 by the operation of the suck pump as the vacuum means. This causes that the air flowing in the liquid room 22 of the cap is reduced and therefore a suck-efficiency of recovering the waste ink is generally reduced.

To settle the matter mentioned above, a weir 61 is formed between the second ink-suck hole 51 and the air-intake hole 41 so as to restrain the air which flows from the air-intake hole 41 from directly flowing into the second ink-suck hole 51. More concretely, the weir 61 is formed so that a space to the circumference wall 32*a* and a space to a lower surface of the cap 20 are slightly left, respectively. Consequently, a part of the air flowing into the collecting room 32 from the air-intake hole 41 detours around the weir 61 and flows into the ink-suck hole 51 while the remainder of the air flows in the liquid room 22 through the first ink-suck holes 23 and 24. Thus, the air flowing in the liquid room 22 is very increased.

In this invention, the weir may be designed into various shapes and sizes so that the air flowing from the air-intake hole 41 is controlled in arbitrary directions.

Figure 7A:
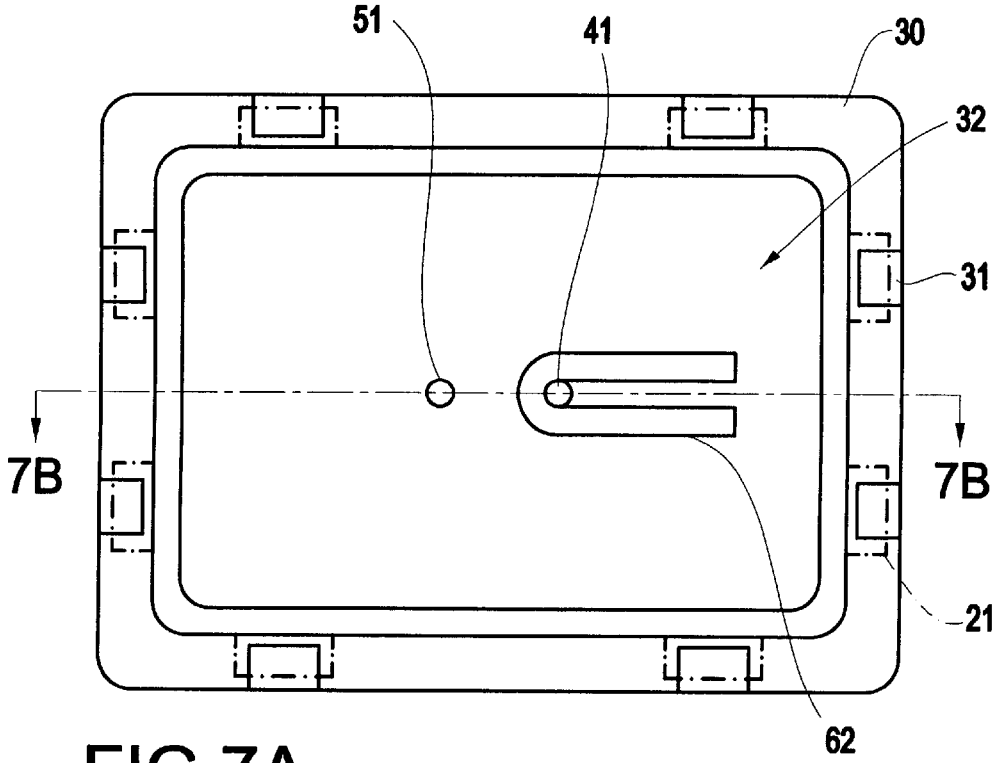
FIG. 7A is a plan view of a ink collector of a head cleaning unit according to the other embodiment of this invention and FIG. 7B is a cross sectional view of the ink collector shown in FIG. 7A as sectioned by an arrow IV—IV.
Figure 7B:
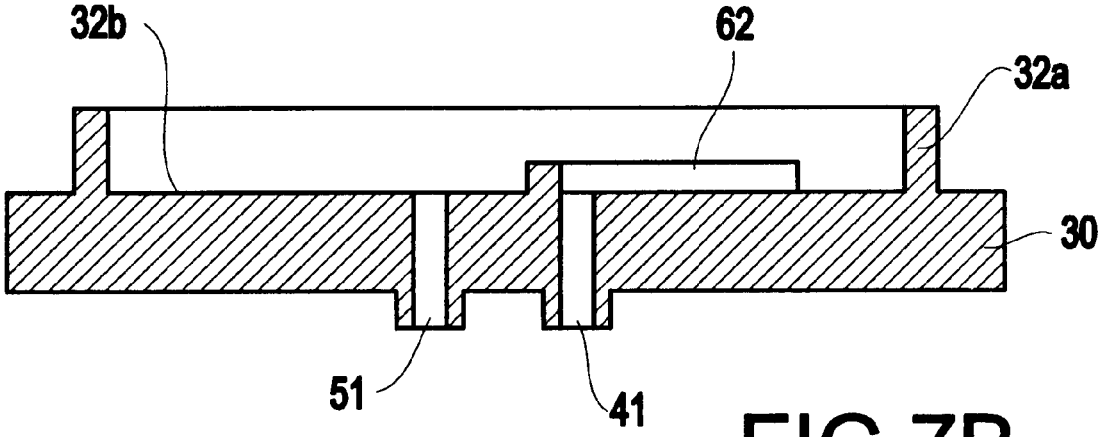

Referring to FIGS. 7A and 7B, the other weir 62 different from the one shown in FIG. 6 has a U-shape. In the hilltop of the U-shape, the air-intake hole 41 is formed. The weir 62 is formed so that a space to the circumference wall 32*a* and a space to the lower surface of the cap 20 are slightly left, respectively. Furthermore, the U-shape is opened toward a side opposite to the other side where the ink-suck hole 51 is formed.

Figure 8:
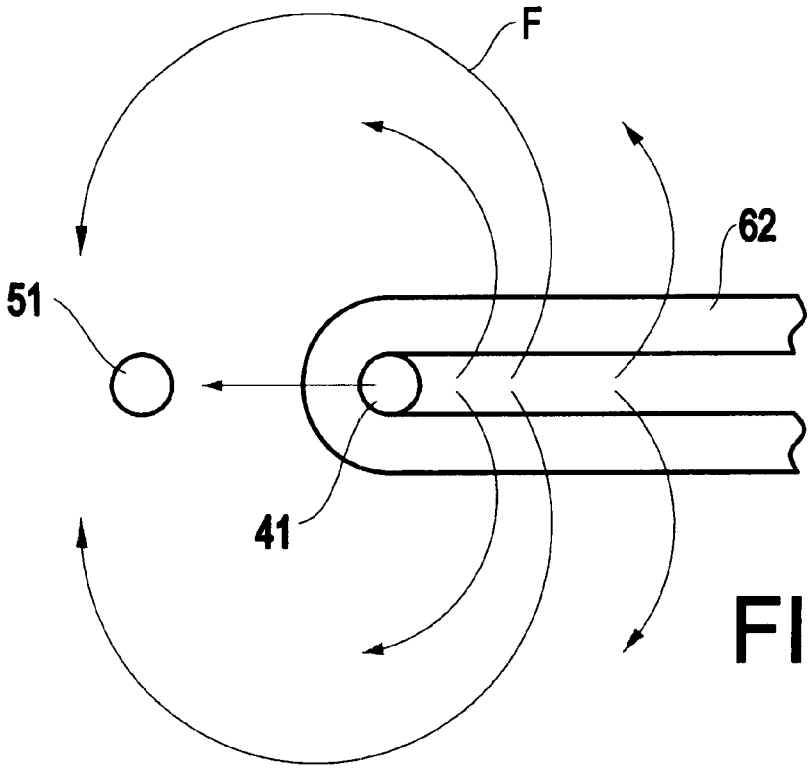
FIG. 8 is an enlarged partial plan view of the ink collector shown in FIG. 7A for illustrating flow of air controlled by a weir.

Consequently, the air flowing from the air-intake hole 41 into the collecting room 32 flows over the weir 62 and diffuses over the collecting room 32. Namely, the air detours around the weir 62 and therefore airflow F are formed as shown in FIG. 8. Furthermore, a part of the air flows in the liquid room 22 through the first ink-suck holes 23 and 24.

Thus, the weir 62 provides more complex and more diffusive airflow to the head cleaning unit than the weir 61 shown in FIG. 6.

Hereinafter, an operation of the head cleaning unit 1 of the embodiments according to this invention will be described with referring to FIGS. 3 to 5.

When the ink-jet printer no performs the print, after the head cleaning unit 1 is moved to the printing head 10 by the drive means (not shown), the cap 20 is stuck on the nozzle surface 11 of the printing head 10.

Then the suck pump (not shown) starts operating, the air in the cap 20 and the ink collector 30 is sucked up through the ink-suck tube 50 and therefore the liquid room 22 and the collecting room 32 are made into the state under the negative pressure. Thus, the air flows into the collecting room 32 of the ink collector 30 through the air-intake hole 41 and the waste ink in the nozzle 12 is sucked up to the liquid room 22 of the cap 20.

In the liquid room 22, the airflow is generated by the air flowing into the collecting room 32 through the air-intake hole 41. Consequently, The waste ink sucked up from the nozzle 12 is further sucked up to the collecting room 32 through the first ink-suck hole 23 and 24. The waste ink sucked up to the collecting room 32 is drained away through the second ink-suck hole 51, the ink-suck tube 50, and the suck pump. The waste ink drained may be reused for the different use.

Because the slope 23*a* is formed around the opening of the first ink-suck hole 23, the slope 22*d* is formed at the corner 22*c* formed by the circumference walls 22*a*, and furthermore the circumference wall 22*a* is formed so that the sectional thickness of upper regions thereof is thin, it is difficult that the waste ink is left near the corner 22*c* of the liquid room 22 and between the nozzle surface 11 and the cap 20. Thus, the waste ink sucked up from the nozzle 12 is sufficiently sucked up to the ink collector 30 without the waste ink left in the liquid room 22.

Furthermore, if the waste ink is left in the liquid room 22, the waste ink is almost sucked up by the air flowing over the liquid room 22. When the waste ink left in the liquid room 22 is sucked up, the grooves 25 formed on the bottom surface 22*b* of the liquid room 22 serve to guide the waste ink for smoothly flowing into the first ink-suck hole 23.

After sucking up the waste ink from the printing head 10 for a predetermined time, the suck pump is stopped operating and the head cleaning unit 1 is moved away from the printing head 10 by the drive means.

While the invention has thus far been described in conjunction with the embodiments thereof, it will readily be possible to put this invention into practice in various other manners.

For example, although the cap 20 and the ink collector 30 are removably engaged to each other by engaging the engaging portion 21 having the dent shape and the engaging portion 31 formed into the protrusion to each other in the above-mentioned embodiments, the cap 20 and the ink collector 30 may be removably engaged by another fastening means such as female and male screws in this invention. Furthermore, instead of a combination of the cap 20 and the ink collector, one part capable of performing an equal function as the combination.

Furthermore, in order to enhance wettability of the waste ink on the bottom surface 22*b* of the liquid room 22 for preventing the waste ink from being left in the liquid room 22, the bottom surface 22*b* may be provided with a suitable surface treatment. Still furthermore, the air-intake hole may be formed on the cap 20.

What is claimed is:

1. A head cleaning unit for an ink-jet printer that cleans a printing head, said head cleaning unit, comprising:

a cap that covers said printing head, said cap including a liquid room comprising a space between a first bottom surface of said liquid room and said printing head and a plurality of a first ink-suck holes disposed on said first bottom surface of said liquid room that communicates with a back surface of said cap, at least one of said plurality of first ink-suck holes being in closer proximity to a periphery of said first bottom surface where said cap and said printing head are in contact; and an ink collector that attaches to said back surface of said cap, said ink collector including a collecting room comprising a space between a second bottom surface of said collecting room and said back surface of said cap, a second ink-suck hole disposed on said second bottom surface, and an air-intake hole disposed on said second bottom surface, wherein said ink collector includes a weir disposed on said second bottom surface of said ink collector that impeded air flow between said air-intake hole and said second ink-suck hole.

2. A head cleaning unit as claimed in claim 1, wherein said weir is formed into a shape such that said air flow is deflected in a direction.

3. A head cleaning unit as claimed in claim 1, wherein said first bottom surface of said cap includes a plurality of grooves that guide waste ink to said plurality of first ink-suck holes.

4. A head cleaning unit as claimed in claim 3, wherein said plurality of grooves are disposed radially on said first bottom surface of said cap.

5. A head cleaning unit as claimed in claim 3, wherein said plurality of grooves are disposed on said first bottom surface of said cap so as to interconnect said plurality of first ink-suck holes.

6. A head cleaning unit as claimed in claim 1, wherein a portion of said plurality of first ink-suck holes are disposed along a periphery of said first bottom surface of said liquid chamber and each of said portion of said plurality of first ink-suck holes comprises a gradually widening cross-section as each of said portion of said plurality of first ink-suck holes approaches said first bottom surface.

7. A head cleaning unit as claimed in claim 6, wherein said portion of said plurality of first ink-suck holes are disposed along a periphery of said first bottom surface of said liquid room with an equal pitch.

8. A head cleaning unit as claimed in claim 1, wherein said liquid chamber gradually widens in cross-section as walls of said liquid chamber approach said printing head.

9. A head cleaning unit as claimed in claim 1, wherein said cap includes a primary engaging portion, said ink collector includes a secondary engaging portion corresponding to said primary engaging portion, and said cap and said ink collector are removably engaged with each other.

10. A head cleaning unit as claimed in claim 1, wherein said cap and said ink collector comprise an integral unit.

11. A head cleaning unit for an ink-jet printer that cleans a printing head by sucking up waste ink from said printing head, said head cleaning unit comprising a cap covering said printing head so as to contact said printing head and vacuum means for generating negative pressure in a liquid room formed in said cap, wherein said head cleaning unit further comprises an ink collector attached to said cap so as to contact with said cap, said cap including a plurality of first ink-suck holes formed on a first bottom surface of said liquid room so as to communicate said liquid room with a space between said cap and said ink collector, said ink collector including a second ink-suck hole formed on a second bottom surface adjacent to said space so as to communicate said space with said vacuum means, at least one of said cap and said ink collector including an air-intake hole for providing air to said at least one of said cap and said ink collector by said vacuum means, at least one of said first ink-suck holes disposed along a contact area where said printing head and said cap contact each other, and said ink collector including a weir formed on said second bottom surface of said ink collector for impeding an air flow that directly flows from said air-intake hole to said second ink-suck hole.

12. A head cleaning unit for an ink-jet printer that cleans a printing head by sucking up waste ink from said printing head, said head cleaning unit comprising a cap covering said printing head so as to contact said printing head and vacuum means for generating negative pressure in a liquid room formed in said cap, wherein said head cleaning unit further comprises an ink collector attached to said cap so as to contact with said cap, said cap including a plurality of first ink-suck holes formed on a first bottom surface of said liquid room so as to communicate said liquid room with a space between said cap and said ink collector, said ink collector including a second ink-suck hole formed on a second bottom surface adjacent to said space so as to communicate said space with said vacuum means, at least one of said cap and said ink collector including an air-intake hole for providing air to said at least one of said cap and said ink collector by said vacuum means, at least one of said first ink-suck holes disposed along a contact area where said printing head and said cap contact each other, said ink collector including a weir formed on said second bottom surface of said ink collector for impending an air flow that directly flows from said air-intake hole to said second ink-suck hole, and said weir being formed into a shape such that the air flow is turned in arbitrary directions.

* * * * *